US010304646B2

(12) United States Patent
Choi

(10) Patent No.: US 10,304,646 B2
(45) Date of Patent: May 28, 2019

(54) AUXILIARY RELAY OF ELECTROMAGNETIC CONTACTOR

(71) Applicant: LSIS CO., LTD., Anyang-si, Gyeonggi-do (KR)

(72) Inventor: Koanho Choi, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 4 days.

(21) Appl. No.: 15/649,525

(22) Filed: Jul. 13, 2017

(65) Prior Publication Data

US 2018/0218863 A1 Aug. 2, 2018

(30) Foreign Application Priority Data

Feb. 2, 2017 (KR) ..... 10-2017-0015111

(51) Int. Cl.

| | |
|---|---|
| ***H01H 50/54*** | (2006.01) |
| ***H01H 36/00*** | (2006.01) |
| ***H01H 51/28*** | (2006.01) |
| ***H01H 50/02*** | (2006.01) |
| ***H01H 50/14*** | (2006.01) |

(52) U.S. Cl.

CPC ..... *H01H 50/541* (2013.01); *H01H 36/0006* (2013.01); *H01H 50/02* (2013.01); *H01H 50/14* (2013.01); *H01H 51/282* (2013.01); *H01H 36/0013* (2013.01)

(58) Field of Classification Search

CPC .. H01H 50/541; H01H 36/0006; H01H 50/02; H01H 50/14; H01H 51/282; H01H 36/0013

See application file for complete search history.

(56) References Cited

U.S. PATENT DOCUMENTS 3,233,060 A * 2/1966 Wintriss ..... H01H 36/0006 200/19.36
3,445,796 A * 5/1969 Kolless ..... H01H 1/66 116/204

(Continued)

FOREIGN PATENT DOCUMENTS

CN 2188242 1/1995
CN 203596954 5/2014

(Continued)

OTHER PUBLICATIONS

Korean Intellectual Property Office Search report dated Sep. 13, 2016, 4 pages.

(Continued)

*Primary Examiner* — Mohamad A Musleh

(74) *Attorney, Agent, or Firm* — K&L Gates LLP

(57) ABSTRACT

The present invention relates to an auxiliary relay for an electromagnetic contactor, the relay including magnet members provided on both sides of a moving member, and first and second conductive members provided on both sides of a frame, whereby an ON or OFF state of the first and second conductive members can be controlled according to the magnet members, in response to a movement of the moving member, so as to configure various contact circuits, such as 1a 1b contact circuit, 2a contact circuit, 2b contact circuit and the like, for the electromagnetic contactor.

10 Claims, 7 Drawing Sheets

(56) References Cited

U.S. PATENT DOCUMENTS

| | | | | |
|---|---|---|---|---|
| 3,557,327 | A * | 1/1971 | Stephen Lepp | H01H 36/0006 200/61.04 |
| 3,593,231 | A * | 7/1971 | Van Horn | H01H 1/54 335/152 |
| 3,735,298 | A * | 5/1973 | Colby | B60K 28/06 335/206 |
| 5,198,789 | A | 3/1993 | Taylor | |
| 7,990,663 | B2 | 8/2011 | Ziegler et al. | |
| 9,734,970 | B1 * | 8/2017 | Choi | H01H 45/04 |
| 2013/0335174 | A1 * | 12/2013 | Kodama | H01H 47/002 335/2 |
| 2014/0049346 | A1 | 2/2014 | Nakahashi et al. | |
| 2015/0288168 | A1 | 10/2015 | Lee et al. | |

FOREIGN PATENT DOCUMENTS

| | | | |
|---|---|---|---|
| CN | 106298368 | A | 1/2017 |
| CN | 107086157 | A | 8/2017 |
| EP | 0437003 | | 7/1991 |
| EP | 3211652 | A1 | 8/2017 |
| JP | S59194252 | U | 12/1984 |
| JP | S61185831 | A | 8/1986 |
| JP | 06-333476 | | 12/1994 |
| JP | 07-021893 | | 1/1995 |
| JP | H10106421 | | 4/1998 |
| JP | 2005166435 | | 6/2005 |
| JP | 2013012316 | | 1/2013 |
| JP | 2014120245 | A | 6/2014 |
| KR | 1019990065899 | | 8/1999 |
| KR | 20090111705 | A | 10/2009 |
| KR | 100976511 | B1 | 8/2010 |
| KR | 20140097619 | A | 8/2014 |

OTHER PUBLICATIONS

Korean Office Action for related Korean Application No. 10-2017-0015111; action dated May 9, 2018; (6 pages).

European Search Report for related European Application No. 17163724.2; report dated Oct. 26, 2017; (9 pages).

English Translation for Chinese Office Action for related Chinese Application No. 201710625435.9; action dated Feb. 2, 2019; (25 pages).

* cited by examiner

AUXILIARY RELAY OF ELECTROMAGNETIC CONTACTOR

CROSS-REFERENCE TO RELATED APPLICATION

Pursuant to 35 U.S.C. § 119(a), this application claims the benefit of earlier filing date and right of priority to Korean Application No. 10-2017-0015111, filed on Feb. 2, 2017, the contents of which are all hereby incorporated by reference herein in its entirety.

BACKGROUND OF THE INVENTION

1. Field of the Invention

This specification relates to an auxiliary relay of an electromagnetic contactor, and more particularly, an auxiliary relay of an electromagnetic contactor, capable of improving current-applying efficiency by preventing an external exposure of a contact portion and variously adjusting a contact configuration.

2. Background of the Invention

Generally, an electromagnetic contactor refers to a device that opens or closes a load in a transmission system, a substation or an electric circuit, or cuts off current when an accident such as a ground or short circuit occurs.

The electromagnetic contactor is provided with an auxiliary relay on its top or side surface to assist an operation of a main contact. FIG. 1 illustrates an electromagnetic contactor having an auxiliary relay on a top thereof.

As illustrated in FIG. 1, an auxiliary relay 10 of the related art electromagnetic contactor is provided with an auxiliary fixed contact 13 on a frame 11, and an auxiliary movable contact 17 formed integrally with a moving member 15. The moving member 15 is connected to a crossbar (not illustrated) of the electromagnetic contactor to move up and down in conjunction with a vertical movement of the crossbar.

Therefore, when an a-contact circuit (NORMAL OPEN) and a b-contact circuit (NORMAL CLOSE) are configured in the electromagnetic contactor, a coil (not illustrated) constituting the main contact of the electromagnetic contactor is excited and thereby a fixed core (not illustrated) is magnetized. Accordingly, a movable core (not illustrated) is moved and the crossbar with the movable core is cooperatively moved. In this instance, the moving member 15 connected to the crossbar also moves together. As a result, the a-contact circuit is in an ON state (current-flowing state) and the b-contact circuit is in an OFF state (current-cutoff state) through the auxiliary fixed contact 13 and the auxiliary movable contact 17.

On the contrary, when the excitation of the coil is terminated, the moving member 15 moves in response to the movement of the crossbar. Accordingly, the a-contact circuit is in the open state and the b-contact circuit is in the closed state.

However, in the auxiliary relay 10 of the related art electromagnetic contactor configured as described above, the auxiliary stationary contact 13 and the auxiliary movable contact 17 are exposed to the outside, so that dust or foreign materials can easily be stuck to the contacts 13 and 17, which causes a problem that the current-flowing efficiency of the auxiliary relay 10 is greatly lowered.

Further, after using the electromagnetic contactor to operate, for example, in a 1a 1b contact circuit configuration, it is difficult to adjust the electromagnetic contactor to operate in a 2a or 2b contact circuit configuration.

SUMMARY OF THE INVENTION

Therefore, to obviate the aforementioned problems and other drawbacks, an aspect of the detailed description is to provide an electromagnetic contactor capable of improving conductivity by preventing an external exposure of a contact portion and variously adjusting a contact configuration.

To achieve these and other advantages and in accordance with the purpose of this specification, as embodied and broadly described herein, there is provided an auxiliary relay for an electromagnetic contactor, the relay including a frame, a moving member movable within the frame and provided with a magnet member, and a first conductive member provided with a first switch portion turned on or off by being brought into close contact with or moved away from the magnet member, in response to a movement of the moving member.

Also, the relay may further include a second conductive member provided with a second switch portion turned on or off by being brought into close contact with or moved away from the magnet member, in response to the movement of the moving member.

The magnet member may be located on each of both sides of the moving member. The first conductive member and the second conductive member may be located on both sides of the frame to be adjacent to the magnet members, respectively. The magnet members may be brought into close contact with or moved away from the first switch portion and the second switch portion as the moving member moves up and down, such that the first switch portion and the second switch portion are turned on or off.

The first switch portion and the second switch portion provided on the first conductive member and the second conductive member may be located at positions corresponding to each other. Accordingly, the second switch portion may be turned on by being brought into close contact with the magnet member disposed on another side when the first switch portion is turned on by being brought into close contact with the magnet member disposed on one side, as the moving member moves. On the contrary, the second switch portion may be turned off by being brought into close contact with the magnet member disposed on another side when the first switch portion is turned off by being brought into close contact with the magnet member disposed on one side, as the moving member moves.

The first switch portion and the second switch portion provided on the first conductive member and the second conductive member may be located at different positions from each other. Accordingly, the second switch portion may be turned off by being brought into close contact with the magnet member disposed on another side when the first switch portion is turned on by being brought into close contact with the magnet member disposed on one side, as the moving member moves. On the contrary, the second switch portion may be turned on by being brought into close contact with the magnet member disposed on another side when the first switch portion is turned off by being brought into close contact with the magnet member disposed on one side, as the moving member moves.

The first switch portion and the second switch portion may be configured as reed switches.

Each of the first conductive member and the second conductive member may be provided with a first terminal and a second terminal that are connected to the first switch portion or the second switch portion, such that a current is applied according to an ON or OFF state of the first switch portion and the second switch portion.

The first terminal and the second terminal may be inclined by predetermined angles.

Magnet member inserting portions in which the magnet members are fixedly inserted may be formed on both side surfaces of the moving member.

Each of the magnet member inserting portions may have front and rear sides open.

On each of both sides of the frame may be provided guide portions in which the corresponding conductive member is inserted, and a hook portion located to be brought into contact with one end of the conductive member.

Each of the conductive members may be provided with a blocking plate provided adjacent to the first switch portion or the second switch portion.

The auxiliary relay for an electromagnetic contactor according to the present invention may include the magnet members provided on both sides of the moving member, and the first and second conductive members provided on both sides of the frame, whereby an ON or OFF state of the first and second conductive members can be controlled according to the magnet members, in response to a movement of the moving member, so as to configure various contact circuits, such as 1a 1b contact circuit, 2a contact circuit, 2b contact circuit and the like, for the electromagnetic contactor.

Positions of reed switches provided in the first and second conductive members may be the same as or different from each other, so as to adjust states of the first and second conductive members by use of the magnet members, which may facilitate configuration of contact circuits of the electromagnetic contactor through a simple structure.

Since the first and second conductive members are turned on or off using a plurality of reed switches, an ON or OFF state of the auxiliary relay can be adjusted in a state that contacts are not externally exposed, thereby preventing dust or foreign materials from being easily stuck on a contact portion.

In addition, since the contact portion is not exposed to the outside, formation of an oxide film due to exposure in the air can be prevented, thereby preventing deterioration of current-flowing efficiency.

Since the dust and foreign materials can be prevented from being easily attached, deterioration of current-flowing efficiency of the auxiliary relay due to the foreign materials can be prevented.

Blocking plates provided on the first conductive member and the second conductive member can prevent magnetic forces of the magnet members from affecting the switch portions when the magnet members are moved away from the switch portions, thereby preventing each of the switch portions from being maintained in an ON state without changing to an OFF state.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, an auxiliary relay for an electromagnetic contactor in accordance with one embodiment of the present invention will be described in detail with reference to the accompanying drawings.

Figure 1:
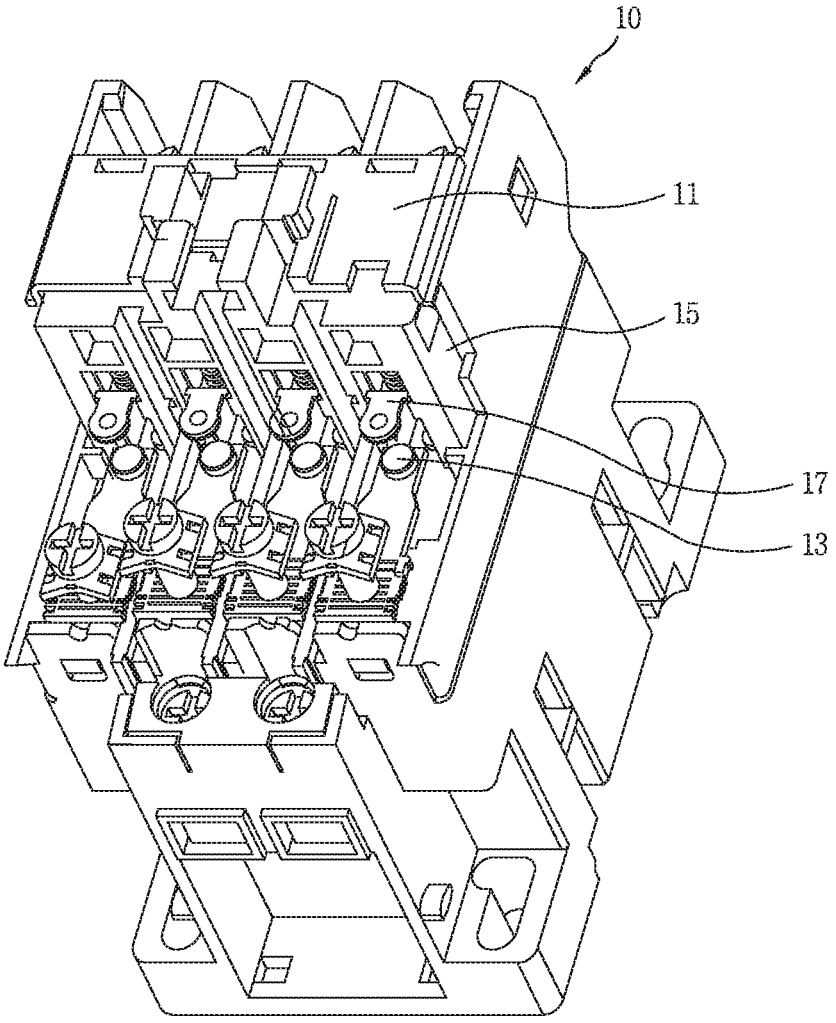
FIG. 1 RELATED ART
FIG. 1 is a perspective view of an electromagnetic contactor provided with the related art auxiliary relay.
Figure 2:
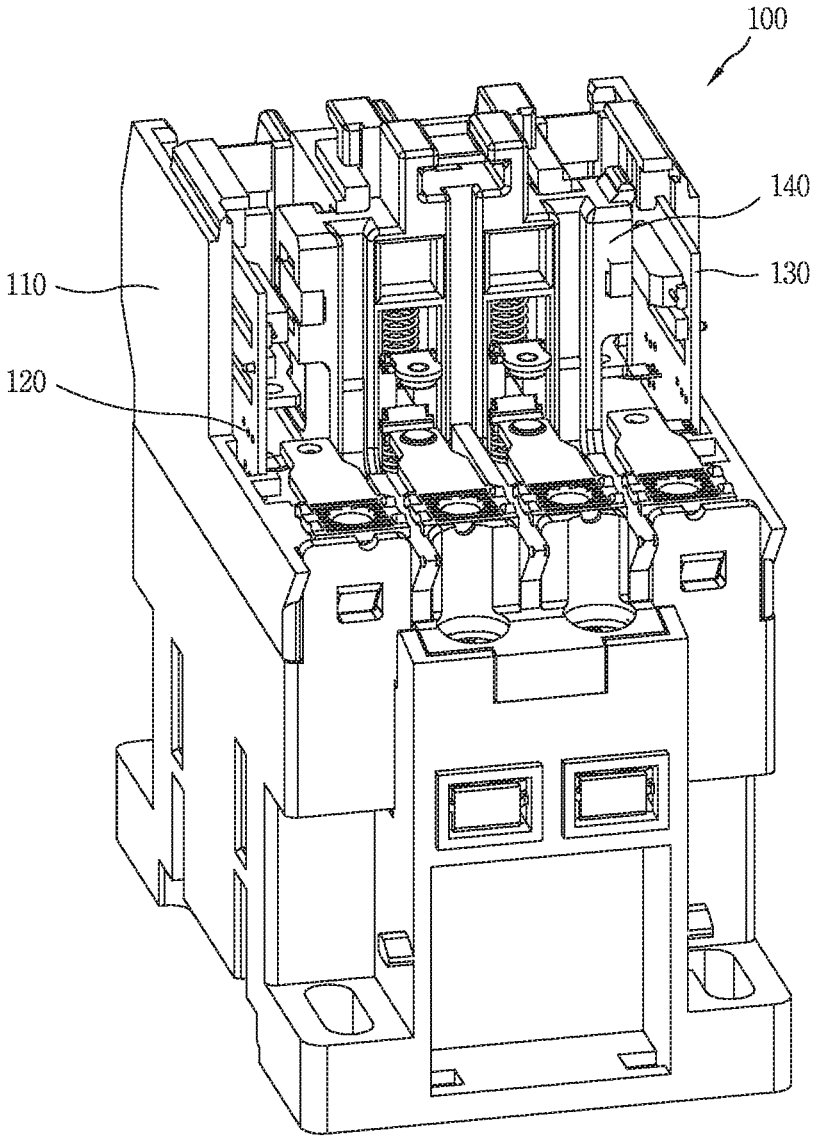
FIG. 2 is a perspective view of an electromagnetic contactor provided with an auxiliary relay in accordance with one embodiment of the present invention.
Figure 3:
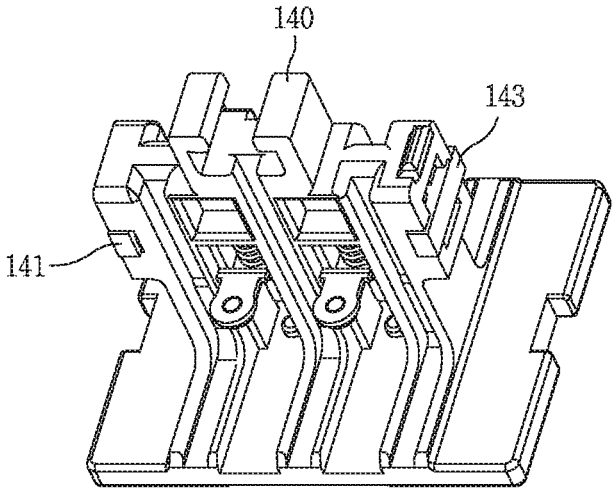
FIG. 3 is a perspective view of a moving member provided in an auxiliary relay in accordance with one embodiment of the present invention.
Figure 4:
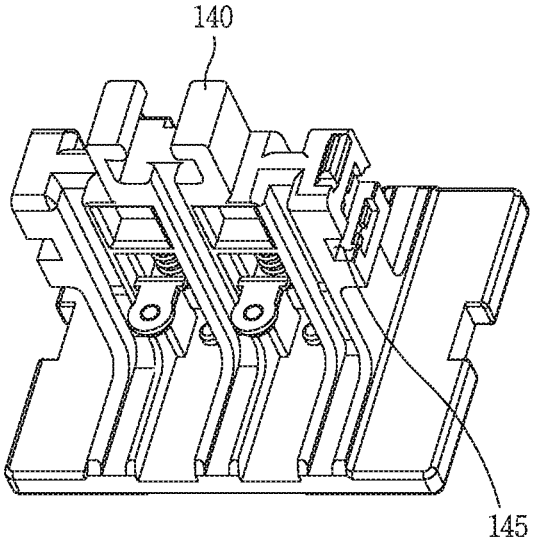
FIG. 4 is a perspective view illustrating a removed state of a magnet member from a moving member provided in an auxiliary relay in accordance with one embodiment of the present invention.
Figure 5A:
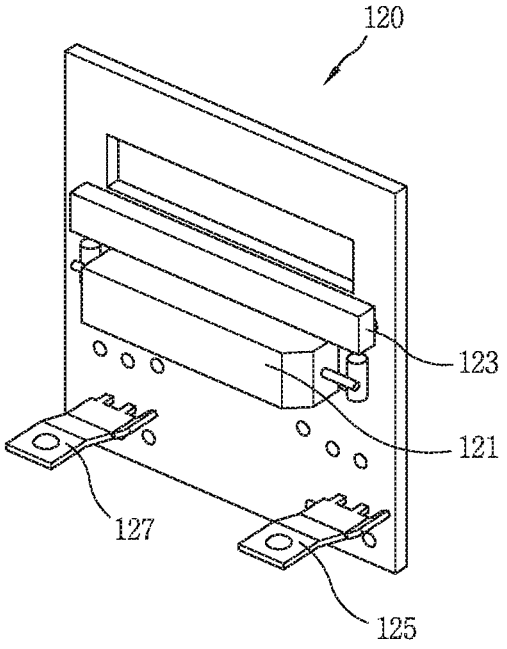
FIG. 5A is a perspective view of a first conductive member constructing an auxiliary relay in accordance with one embodiment of the present invention.
Figure 5B:
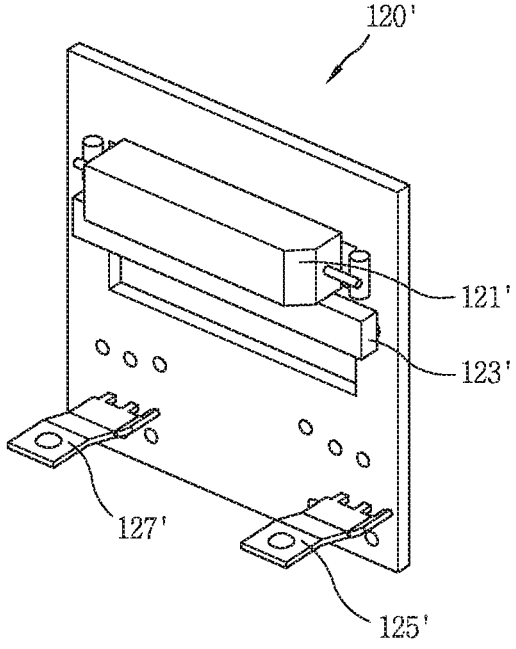
FIG. 5B is a perspective view of a first conductive member constructing an auxiliary relay in accordance with another embodiment of the present invention.

FIG. 2 is a perspective view of an electromagnetic contactor provided with an auxiliary relay in accordance with one embodiment of the present invention, FIG. 3 is a perspective view of a moving member provided in an auxiliary relay in accordance with one embodiment of the present invention, FIG. 4 is a perspective view illustrating a removed state of a magnet member from a moving member provided in an auxiliary relay in accordance with one embodiment of the present invention, FIG. 5A is a perspective view of a first conductive member constructing an auxiliary relay in accordance with one embodiment of the present invention, and FIG. 5B is a perspective view of a first conductive member constructing an auxiliary relay in accordance with another embodiment of the present invention.

Figure 6:
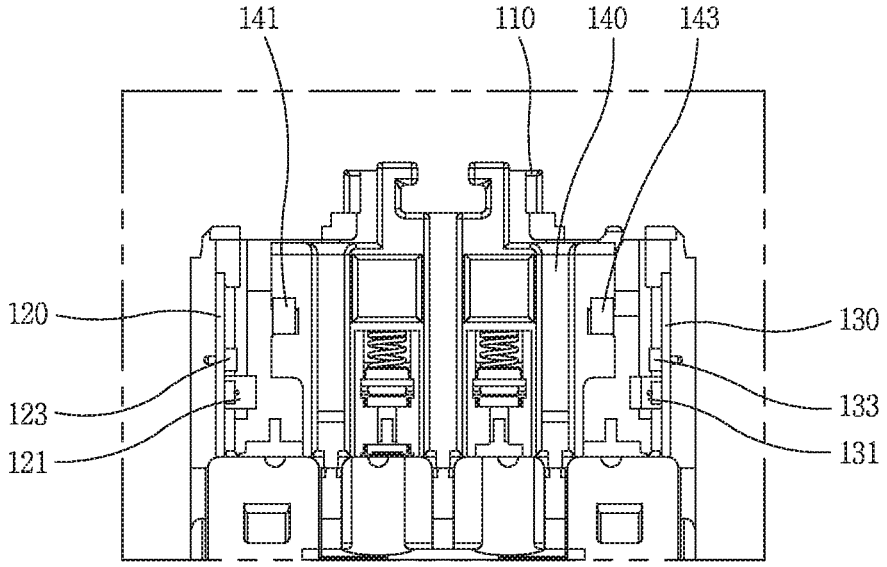
FIG. 6 is an internal configuration view illustrating a state that a first conductive member and a second conductive member are employed in an auxiliary relay to configure a 2a contact circuit in an OFF state of an electromagnetic contactor according to one embodiment.
Figure 7:
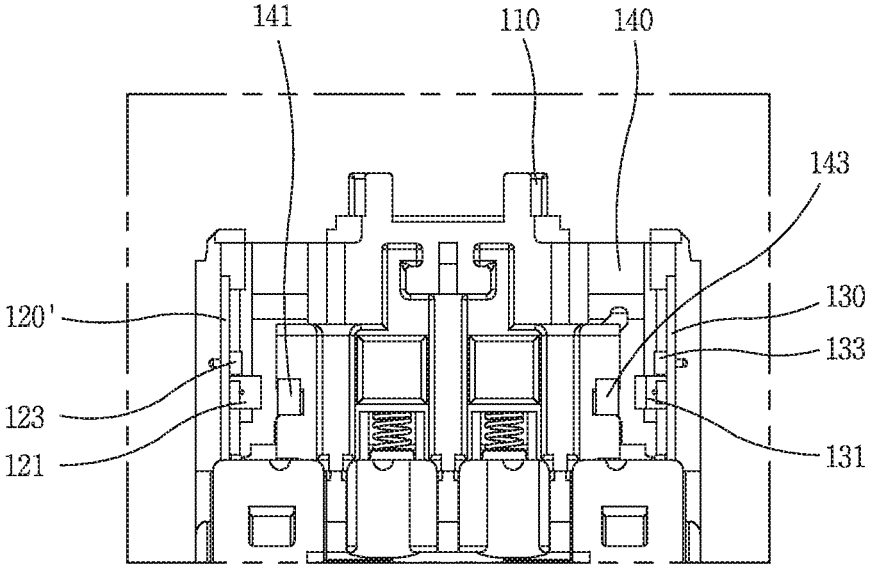
FIG. 7 is an internal configuration view illustrating a state that a first conductive member and a second conductive member are employed in an auxiliary relay to configure a 2a contact circuit in an OFF state of an electromagnetic contactor according to one embodiment of the present invention.
Figure 8:
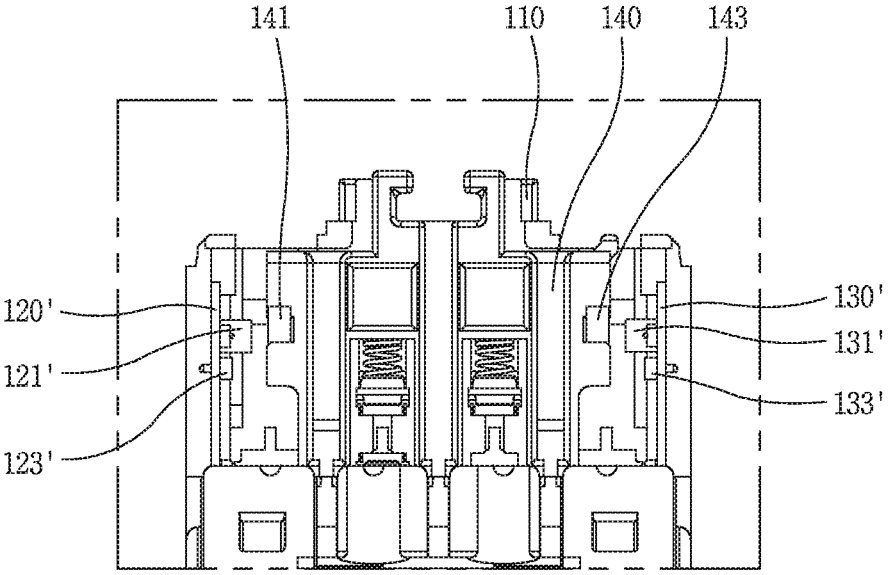
FIG. 8 is an internal configuration view illustrating a state that a first conductive member and a second conductive member are employed in an auxiliary relay to configure a 2b contact circuit in an OFF state of an electromagnetic contactor according to one embodiment of the present invention.
Figure 9:
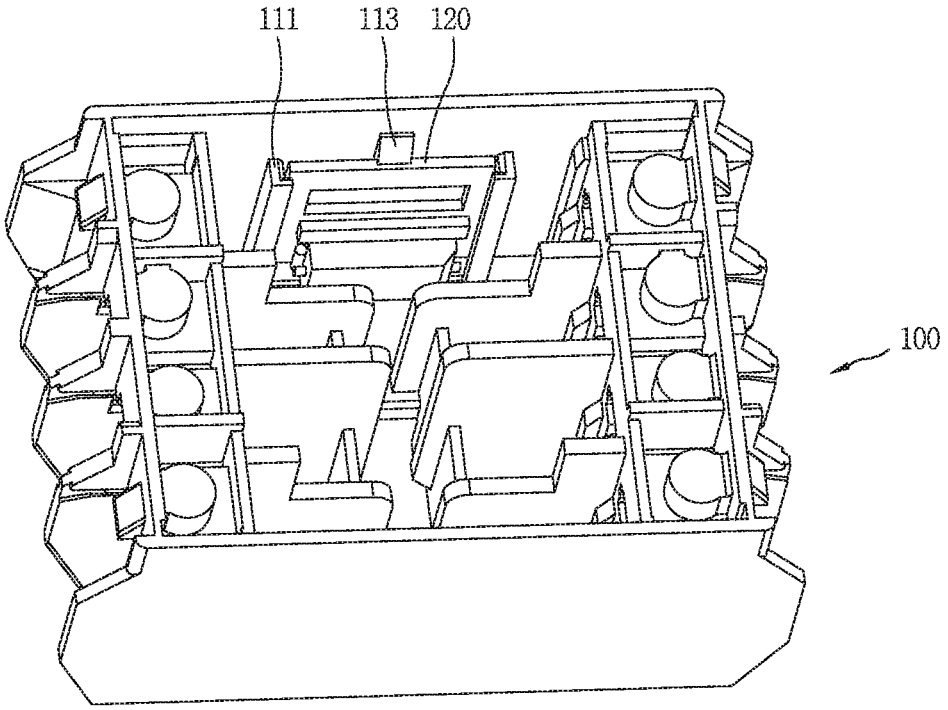
FIG. 9 is a perspective view illustrating a state that a conductive member constructing an electromagnetic contactor according to the present invention is inserted in an auxiliary relay.

Also, FIG. 6 is an internal configuration view illustrating a state that a first conductive member and a second conductive member are employed in an auxiliary relay to configure a 2a contact circuit in an OFF state of an electromagnetic contactor according to one embodiment, FIG. 7 is an internal configuration view illustrating a state that a first conductive member and a second conductive member are employed in an auxiliary relay to configure a 2a contact circuit in an OFF state of an electromagnetic contactor according to one embodiment of the present invention, FIG. 8 is an internal configuration view illustrating a state that a first conductive member and a second conductive member are employed in an auxiliary relay to configure a 2b contact circuit in an OFF state of an electromagnetic contactor according to one embodiment of the present invention, and FIG. 9 is a perspective view illustrating a state that a conductive member constructing an electromagnetic contactor according to the present invention is inserted in an auxiliary relay.

As illustrated in FIGS. 2 to 5A, an auxiliary relay 100 provided in an electromagnetic contactor according to the present invention includes a frame 110, a moving member 140, a first conductive member 120 and a second conductive member 130.

The frame 110 defines appearance of the auxiliary relay 100, and is provided with various components constructing the auxiliary relay 100.

The moving member 140 is provided within the frame 110 and connected to a crossbar (not illustrated) which is constructs a main contact of the electromagnetic contactor. In this connected state, the moving member 140 moves up and down in response to a movement of the crossbar.

In this instance, magnet member inserting portions 145 each of which has front and rear portions open are provided on both sides of the moving member 140. Magnet members 141 and 143 are inserted into the magnet member inserting portions 145 to be movable in response to the movement of the moving member 140, thereby controlling an ON or OFF state of the first conductive member 120 and the second conductive member 130.

The first conductive member 120 is provided on one side of the frame 110 to be adjacent to the magnet member 141 within the frame 110. The first conductive member 120 is turned on or off by being closely adhered on the magnet member 141 or moved away from the magnet member 141 in response to the movement of the moving member 140.

In this instance, the first conductive member 120 is provided with a first switch portion 121 configured as a reed switch or the like. When the moving member 140 moves, the magnet member 141 is closely adhered on or moved away from the first switch portion 121, thereby switching on or off the first conductive member 120.

That is, the reed switch is configured such that contact portions of magnetic material reeds are located in a glass tube filled with an inert gas. When permanent magnets and the like are positioned near the contact portions of the respective reeds in an OFF state in which the contact portions are separated from each other, the contact portions of the reeds are contacted by an external magnetic field such that the reed switches is in an ON state.

Therefore, the first switch portion 121 is turned on or off by using the reed switches. This may allow an ON or OFF state of the auxiliary relay 100 to be adjustable without externally exposing contacts, thereby preventing dust or foreign materials from being easily stuck on the contact portions.

A first terminal 125 and a second terminal 127, which are inclined by predetermined angles to be electrically connected to the first switch portion 121, respectively, are provided on the first conductive member 120.

When the first switch portion 121 is turned on through the magnet member 141, a current flows through the first terminal 125 or the second terminal 127.

The second conductive member 130 is provided on another side of the frame 110 to be adjacent to the magnet member 143 within the frame 110. Accordingly, the second conductive member 130 is switched on or off by being brought into close contact with or moved away from the magnet member 143 in response to the movement of the moving member 140.

In this instance, the second conductive member 130 is provided with a second switch portion 131, which is configured as a reed switch in the same manner as the first conductive member 120. When the moving member 140 moves, the magnet member 141 are brought into close contact with the second switch portion 131 or moved away from the second switch portion 131 so that the second conductive member 130 is turned on or off.

The second conductive member 130 is also provided, similar to the first conductive member 120, with a first terminal (not illustrated) and a second terminal (not illustrated) which are inclined by predetermined angles. Accordingly, when the second switch portion 131 is adjusted into an ON state, a current flows through the first terminal or the second terminal.

In the present invention, the magnet members 141 and 143 are provided on both sides of the moving member 140, and the first conductive member 120 and the second conductive member 130 are provided on both sides of the frame 110. Accordingly, the first conductive member 120 and the second conductive member 130 are controlled to be turned on or off into the same state or into different states through the magnet members 141 and 143, thereby enabling the electromagnetic contactor to have various contact circuit configurations, such as 1a, 1b 2a, 2b and the like In more detail, the first conductive member 120 includes the first switch portion 121, a blocking plate 123 and the like, and the second conductive member 130 includes the second switch portion 131, a blocking plate 133 and the like.

In this instance, when the moving member 140 moves up and down in conjunction with the movement of the crossbar, the magnet members 141 and 143 are brought into close contact with or moved away from the first switch portion 121 and the second switch portion 131. Accordingly, the first conductive member 120 and the second conductive member 130 are controlled to be turned on or off.

That is, as illustrated in FIGS. 6 and 7, when the coil (not illustrated) of the electromagnetic contactor is excited in a state where the first conductive member 120 and the second conductive member 130 are provided on both sides of the electromagnetic contactor, the fixed core (not illustrated) is magnetized and thus the movable core (not illustrated) moves downward. Accordingly, the crossbar (not illustrated) provided with the movable core and the moving member 140 connected to the crossbar move downward, such that the first switch portion 121 and the second switch portion 131 are controlled to be turned on through the magnet members 141 and 143. As a result, the electromagnetic contactor is adjusted to be in an 2a contact circuit configuration.

The 2a contact circuit configuration is a type in which two a-contact circuits are constructed in the electromagnetic contactor. Since the first switch portion 121 and the second switch portion 131 are controlled to be in the ON state while a current flows, the electromagnetic contactor is adjusted to have the 2a contact circuit configuration.

Meanwhile, as illustrated in FIG. 8, in another embodiment of the present invention, a first switch portion 121' and a second switch portion 121' provided in a first conductive member 120' and a second conductive member 130' may be adjusted to be positioned above blocking plates 123' and 133' so that the electromagnetic contactor has a 2b contact circuit configuration.

That is, when the current is cut off and the excitation of the coil is terminated, the movable core moves upward. In response to the upward movement, the crossbar connected to the movable core moves upward such that the moving member 140 moves upward.

In this instance, the first conductive member 120' and the second conductive member 120', which are configured such that the first switch portion 121' and the second switch portion 131' are positioned above the blocking plates 123' and 133', are provided on both sides of the frame 110 of the auxiliary relay 100. Accordingly, the magnet members 141 and 143 are brought into close contact with the first and second switch portions 121' and 131' such that each of the switch portions 121' and 131' are turned on.

Therefore, the b-contact circuit in which each of the switch portions 121' and 131' are switched from the OFF state without a current flow into the ON state, and accordingly, the electromagnetic contactor is adjusted to be in the 2b contact circuit configuration.

Alternatively, the electromagnetic contactor may be adjusted to have a 1a 1b contact circuit configuration in a manner that the first switch portion 121, 121' and the second switch portion 131, 131' provided in the first conductive member 120, 120' and the second conductive member 130, 130' are controlled to be located at different positions.

For example, when the first switch portion 121 is positioned below the blocking plate 123 and the second switch portion 131' is positioned above the blocking plate 133', a current flows on the electromagnetic contactor. Accordingly, when the moving member 140 moves downward in response to the current flow, the first switch portion 121 is controlled to be in the ON state and the second switch portion 131' is controlled to be in the OFF state, opposite to the first switch portion 121. As a result, in the current-flowing state, the first conductive member 120 and the second conductive member 130' are opposed to each other, so that the entire contact circuit configuration of the electromagnetic contactor is adjusted to 1a 1b.

Meanwhile, the first conductive member 120, 120' and the second conductive member 130, 130' are provided with the blocking plates 123, 123' and 133 133', respectively, to be adjacent to the first switch portion 121, 121' or the second switch portion 131, 131'.

The blocking plates 123, 123' and 133 133' are located adjacent to the first switch portion 121, 121' or the second switch portion 131, 131'.

Therefore, after the magnet members 141 and 143 are positioned closely to the first switch portion 121, 121' and the second switch portion 131, 131' in response to the movement of the moving member 140 so that each of the switch portions 121, 121', 131, 131' is adjusted to the ON state, when the magnet members 141 and 143 are moved away from the first switch portion 121, 121' and the second switch portion 131, 131' in response to the movement of the moving member 140 so that each of the switch portions is adjusted to the OFF state, the blocking plates 123, 123' and 133 133' prevents the switch portions 121, 121', 131, 131' from being maintained in the ON state with failing to be adjusted to the OFF state, resulting from magnetic forces of the magnet members 141 and 143 affected to the switch portion 121, 121', 131, 131'.

Also, as illustrated in FIG. 9, guide portions 111 and a hook portion 113 are formed on each of both sides of the frame 110. In a state that the conductive members 120, 130 is inserted into each side of the frame along the guide portions 111, the conductive member 120, 130 is located in a manner that one surface thereof is brought into contact with one surface of the hook portion 113, which may allow the conductive member 120, 130 to be firmly inserted into the frame 110.

Hereinafter, a process of adjusting a contact circuit configuration through the auxiliary relay 100 of the electromagnetic contactor according to the present invention will be described in detail.

First, as illustrated in FIGS. 6 and 7, the electromagnetic contactor can be adjusted to have the 2a-contact circuit configuration. When an a-contact circuit (NORMAL OPEN) and a b-contact circuit (NORMAL CLOSE) are configured in the electromagnetic contactor, the first conductive member 120 and the second conductive member 130 formed in the same manner as the first conductive member 120 are provided, as illustrated in FIG. 5A, on both sides of the frame 110. In this state, when a current flows and the coil constructing the main contact of the electromagnetic contactor is excited accordingly, the fixed core is magnetized and the movable core moves downward accordingly. The crossbar provided with the movable core also moves downward, so that the moving member 140 moves down together.

In this instance, since the first switch portion 121 and the second switch portion 131 are configured to be located below the blocking plates 123 133, as well as being located at positions corresponding to each other, when the moving member 140 moves downward, the magnet members 141 and 143 are brought into close contact with the first switch portion 121 and the second switch portion 131, so that the first conductive member 120 and the second conductive member 130 are all turned on.

When the excitation of the coil is terminated, the moving member 140 moves upward in response to the movement of the crossbar. Accordingly, the magnet members 141 and 143 move away from the first switch portion 121 and the second switch portion 131 such that the first switch portion 121 and the second switch portion 131 are all turned off.

In this instance, the blocking plates 123 and 133 prevents each of the switch portions 121 and 131 from being maintained in the ON state due to an affection of the magnetic forces of the magnet members 141 and 143 the first switch portion 121 and the second switch portion 131 via the blocking plates 123 and 133.

Therefore, in a state where a current flows through the electromagnetic contactor, the first conductive member 120 and the second conductive member 130 are both turned on, and thus the electromagnetic contactor is adjusted to the 2a contact circuit configuration.

Meanwhile, as illustrated in FIG. 8, when the first switch portion 121' and the second switch portion 131' included in the first conductive member 120' and the second conductive member 130' are positioned above the blocking plates 123' and 133', the electromagnetic contactor is adjusted to have the 2b contact circuit configuration.

That is, in the state where the first conductive member 120' and the second conductive member 130' illustrated in FIG. 5B are provided on both sides of the frame 110, when the excitation of the coil is terminated, the crossbar moves upward and the moving member 140 moves upward accordingly. The magnet members 141 and 143 are then brought into close contact with the first switch portion 121' and the second switch portion 131'. Accordingly, the first switch portion 121' and the switch portion 131' are all turned on.

Therefore, each of the conductive members 120 and 130 are all adjusted to the ON state when the electromagnetic contactor is in the OFF state in which a current does not flow. Thus, the electromagnetic contactor is adjusted to have the 2b contact circuit configuration.

In the present invention having such configuration, the magnet members 141 and 143 are provided on both sides of the moving member 140 and the first conductive member 120 and the second conductive member 130 are provided on both sides of the frame 110. With the configuration, the first conductive member 120 and the second conductive member 130 are controllable to be in the ON or OFF state by use of the magnet members 141 and 143, in response to the movement of the moving member 140. This may allow the electromagnetic contactor to be adjusted into various contact circuit configurations, such as 1a 1b, 2a, 2b, and the like.

The positions of the reed switches provided in the first conductive member 120 and the second conductive member 130 may be changed to be the same or different from each other so that the states of the first conductive member 120 and the second conductive member 120 can be adjusted through the magnet members 141 and 143. This simple structure may facilitate the state of the electromagnetic contactor to be easily adjusted.

The first conductive member 120 and the second conductive member 130 may be turned on or off by using a plurality of reed switches so that the ON or OFF state of the auxiliary relay 100 can be adjusted without externally exposing contacts, thereby preventing dust or foreign materials from being stuck on contact portions.

In addition, since the contact portion is not exposed to the outside, formation of an oxide film due to exposure in the air can be prevented, thereby preventing deterioration of current-flowing efficiency.

Since the dust and foreign materials can be prevented from being easily attached, deterioration of current-flowing (/applying) efficiency of the auxiliary relay 100 due to the foreign materials can be prevented.

The blocking plates 123, 123' and 133, 133' are provided on the first conductive member 120, 120' and the second conductive member 130 130', respectively. This may prevent magnetic forces of the magnet members 141 and 143 from being applied to the respective switch portions 121, 121' and 131, 131' when the magnet members 141 and 143 move away from the switch portions 121, 121' and 131, 131', which may result in preventing each of the switch portions 121, 121' and 131, 131' from being maintained in the ON state with failing to be changed into the OFF state.

It should be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An auxiliary relay for an electromagnetic contactor, the relay comprising:

a frame;

a moving member movable within the frame and provided with a magnet member;

a first conductive member provided with a first switch portion turned on or off by being brought into close contact with or moved away from the magnet member, in response to a movement of the moving member, and a second conductive member provided with a second switch portion turned on or off by being brought into close contact with or moved away from the magnet member, in response to the movement of the moving member, wherein each of the first and second conductive members is provided with a blocking plate provided adjacent to the first switch portion or the second switch portion.

2. The relay of claim 1, wherein the magnet member is located on each of both sides of the moving member, wherein the first conductive member and the second conductive member are located on both sides of the frame to be adjacent to the magnet members, respectively, and wherein the magnet members are brought into close contact with or moved away from the first switch portion and the second switch portion as the moving member moves up and down, such that the first switch portion and the second switch portion are turned on or off.

3. The relay of claim 2, wherein the first switch portion and the second switch portion provided on the first conductive member and the second conductive member are located at positions corresponding to each other, wherein the second switch portion is turned on by being brought into close contact with the magnet member disposed on another side when the first switch portion is turned on by being brought into close contact with the magnet member disposed on one side, as the moving member moves, and wherein the second switch portion is turned off by being brought into close contact with the magnet member disposed on another side when the first switch portion is turned off by being brought into close contact with the magnet member disposed on one side, as the moving member moves.

4. The relay of claim 2, wherein the first switch portion and the second switch portion provided on the first conductive member and the second conductive member are located at different positions from each other, wherein the second switch portion is turned off by being brought into close contact with the magnet member disposed on another side when the first switch portion is turned on by being brought into close contact with the magnet member disposed on one side, as the moving member moves, and wherein the second switch portion is turned on by being brought into close contact with the magnet member disposed on another side when the first switch portion is turned off by being brought into close contact with the magnet member disposed on one side, as the moving member moves.

5. The relay of claim 1, wherein the first switch portion and the second switch portion are configured as reed switches.

6. The relay of claim 5, wherein each of the first conductive member and the second conductive member is provided with a first terminal and a second terminal that are connected to the first switch portion or the second switch portion, such that a current is applied according to an ON or OFF state of the first switch portion and the second switch portion.

7. The relay of claim 6, wherein the first terminal and the second terminal are inclined by predetermined angles.

8. The relay of claim 1, wherein magnet member inserting portions in which the magnet members are fixedly inserted are formed on both side surfaces of the moving member.

9. The relay of claim 8, wherein each of the magnet member inserting portions has front and rear sides open.

10. The relay of claim 1, wherein guide portions and a hook portion are provided on each of both sides of the frame, wherein a corresponding conductive member is inserted into the guide portions, and wherein the hook portion is located to be brought into contact with one end of the corresponding conductive member.

* * * * *